US005814948A

United States Patent [19]

Teremy

[11] Patent Number: 5,814,948

[45] Date of Patent: Sep. 29, 1998

[54] FLASH CIRCUIT FOR LOW COST CAMERAS

[75] Inventor: Paul Teremy, Rochester, N.Y.

[73] Assignee: Eastman Kodak Company, Rochester, N.Y.

[21] Appl. No.: 783,168

[22] Filed: Jan. 14, 1997

[51] Int. Cl.[6] ..... H05B 37/00

[52] U.S. Cl. ..... 315/241 P; 315/241 R; 315/239; 315/219

[58] Field of Search ..... 315/241 P, 241 R, 315/239, 219, 200 A; 396/6, 202; 354/145.1, 127.11, 418, 147, 288

[56] References Cited

U.S. PATENT DOCUMENTS

| | | | |
|---|---|---|---|
| 3,710,701 | 1/1973 | Takishima et al. | 315/241 P X |
| 3,716,752 | 2/1973 | Iwata | 315/151 |
| 3,723,810 | 3/1973 | Mashimo | 315/241 P |
| 3,764,849 | 10/1973 | Ohta | 315/241 P X |
| 4,002,947 | 1/1977 | Holtzman | 217/12 A |
| 4,066,953 | 1/1978 | Gold | 324/123 R |
| 4,084,134 | 4/1978 | Nagano | 324/133 |
| 4,205,264 | 5/1980 | Gold | 324/51 |
| 4,418,314 | 11/1983 | Nieto, Jr. | 324/72.5 |
| 4,579,702 | 4/1986 | Maruyama et al. | 264/56 |
| 4,610,521 | 9/1986 | Inoue | 315/241 P X |
| 4,614,999 | 9/1986 | Onodera et al. | 363/28 |
| 4,672,273 | 6/1987 | Ikawa et al. | 315/241 P |
| 5,172,067 | 12/1992 | Hoffmann | 324/713 |
| 5,204,764 | 4/1993 | Maeda et al. | 359/60 |
| 5,293,113 | 3/1994 | Beha et al. | 324/72.5 |
| 5,414,344 | 5/1995 | Chinn | 324/72 |
| 5,420,781 | 5/1995 | Schmidt | 363/98 |
| 5,574,337 | 11/1996 | Dunsmore | 315/241 P |
| 5,634,153 | 5/1997 | Constable | 315/241 P X |

FOREIGN PATENT DOCUMENTS 7-122398 5/1995 Japan .

OTHER PUBLICATIONS

Harris Semiconductor Transient Voltage Suppression, 1993, 2–8 thru 2–10 and 3–1 thru 3–5.

*Primary Examiner*—Robert J. Pascal
*Assistant Examiner*—Haissa Philogene
*Attorney, Agent, or Firm*—Francis H. Boos, Jr.

[57] ABSTRACT

A flash circuit for a low cost camera in which a voltage dependent resistor is employed as a flash capacitor charge voltage sensing device to perform a control effect in the flash circuit, such as turning on a flash ready indicator light or activating a oscillation terminating device to arrest self oscillations in a flash charging circuit.

3 Claims, 1 Drawing Sheet

FLASH CIRCUIT FOR LOW COST CAMERAS

FIELD OF THE INVENTION

The invention relates generally to the field of photography, and in particular to a flash circuit for low cost photographic cameras such as recyclable, single use cameras.

BACKGROUND OF THE INVENTION

In the very competitive, high volume market for low cost single use photographic cameras, reduction of manufacturing cost is an important objective in the design and development process. Commonly assigned U.S. Pat. No. 5,574,337 shows an efficient flash circuit currently in use in single use cameras manufactured by Eastman Kodak Company that utilizes a minimum of components and conserves battery power consumption through the use of a flash charge feedback sensor circuit to terminate flash charging operation when the main flash capacitor reaches full charge. An automatic charge restart feature is also incorporate to restart charging of the flash capacitor at the conclusion of each picture taking event.

The '337 circuit provides a flash capacitor charge voltage sensor and indicator arrangement using a neon ready light in series with a fixed value resistor. When the flash capacitor reaches a predetermined charge level, the neon ready light breaks down and begins to glow indicating that sufficient flash capacitor charge exists to operate a flash tube to take a flash picture. A feedback circuit includes a conventional zener diode that responds to voltage across the fixed resistor to break down and conduct when the flash charge voltage reaches a maximum charge voltage that represents a full charge condition. When the zener conducts, it triggers a shunting switch (transistor) that turns off operation of the flash charging circuit. Neon indicator lights and zener feedback diodes have been used in numerous examples of prior art camera flash circuits. In addition to the examples just described, it is also known in flash circuit to use a zener diode in series with a low cost light emitting diode (LED) in place of a neon indicator light as the charge voltage sensor and indicator. However, zener diodes and neon indicators are relatively costly to use and it is desirable to find less costly alternatives.

Voltage dependent resistors, generally referred to as varistors, are known for use in circuits typically as high voltage suppression devices to protect downstream circuits from incoming voltage spikes or surges. A varistor is composed primarily of zinc oxide with some additives. The structure consists of a matrix of conductive zinc oxide grains separated by grain boundaries providing P-N junction semiconductor characteristics providing electrical behavior similar to back-to-back zener diodes. The cost of a varistor is somewhat lower than a zener diode. While, as noted, varistors have been commonly used as circuit protective devices, it is not known that they have been used to any great extent, if at all, as voltage sensor devices. Specifically, it is not believed that varistors have been used as voltage sensors in camera flash circuits. Their general acceptance as heavy duty surge, i.e. voltage spike, circuit protective devices in fact does not lead to any conclusion that they would be good candidates as sensors for the type of circuit operations as encountered in camera flash circuits.

SUMMARY OF THE INVENTION

In accordance with the invention, therefore, there is provided a flash circuit for a low cost camera that includes a flash illumination element, a flash capacitor providing energy to illuminate said element, and an oscillating circuit for charging said capacitor; in which the flash circuit comprises a voltage sensing circuit including a voltage dependent resistor for sensing a voltage proportional to energy stored in said flash capacitor to produce a control effect on a component in the flash circuit when voltage reaches a predetermined level.

These and other aspects, objects, features and advantages of the present invention will be more clearly understood and appreciated from a review of the following detailed description of the preferred embodiments and appended claims, and by reference to the accompanying drawings.

DETAILED DESCRIPTION OF THE INVENTION

Figure 1:
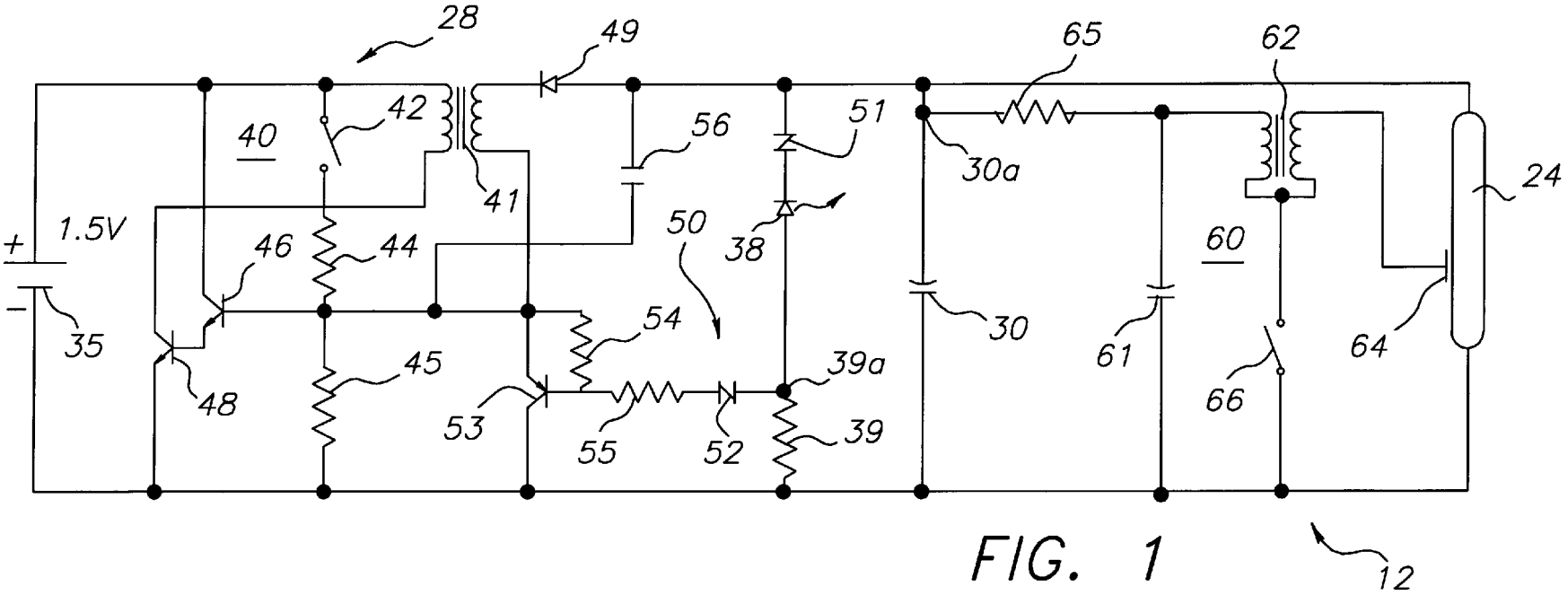
FIG. 1 is a circuit diagram of a camera flash circuit employing voltage sensitive resistor voltage sensors in accordance with the invention.
Figure 2:
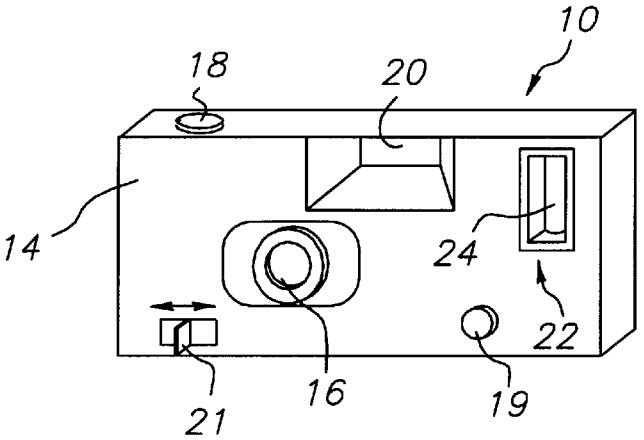
FIG. 2 is a diagrammatic illustration of a single use camera in which the present invention is particularly useful.

In the drawings, a flash circuit according to the invention is depicted in FIG. 1 for use in an inexpensive, single use camera 10 as shown in FIG. 2. The camera includes a body 14, a taking lens 16, a shutter actuating button 18 and flash charging button 19, a viewfinder 20 and a flash device 22 including a flash tube 24. The camera body 14 is adapted to receive and locate photographic film in a predetermined exposure position relative to the other camera components. Shutter actuator button 18 initiates a sequence which exposes the film through optical system 16 with supplemental illumination from flash device 22. A flash charging button 19 is coupled to a momentary switch 42 in the flash circuit of FIG. 1 that initiates a flash charging cycle prior to the exposure sequence. The camera is pointed at the intended subject with the aid of viewfinder 20. A switch 21 may be provided for selection by the camera user of image frame aspect ratio data to be recorded on the film.

In FIG. 1, a flash circuit 12, includes a flash energy supply circuit 28, a flash charge capacitor 30, a flash trigger circuit 60 and flash tube 24. Flash energy supply circuit 28 comprises a battery 35, a self-oscillating flash charging circuit 40, and a rectifier diode 49. A flash ready indicator circuit comprises LED ready light 38, a current limiting resistor 39 and, in accordance with one aspect of the invention, a varistor 51 which serves as a flash charge voltage sensor component to cause LED to light when the charge voltage across flash capacitor 30 reaches a predetermined level sufficient to maintain flash illumination in flash tube 24. An oscillation arresting feedback circuit 50 comprises a PNP transistor switch 53 and, in accordance with another aspect of the invention, a varistor 52 which is responsive to voltage across resistor 39 to trigger transistor 53 into conduction when charge voltage across flash capacitor 30 reaches full charge to terminate oscillations in charging circuit 40. Capacitor 56 serves as an efficiency diode in the charging circuit 40 and also serves to enhance energy feedback to restart oscillations in charging circuit 40 after each picture taking event.

Operation of the self-oscillating charging circuit 40 begins when flash charging button 19 is depressed. This effects closing of momentary switch 42, thereby establishing current flow from battery 35 through resistor 44 to the bases of high gain transistors 46 and 48 thereby initiating current flow through the primary winding of charging transformer 41. The induced stepped up voltage in the secondary winding of transformer 41 is fed back to the base of transistor 46 to continue the current flow in the primary winding. When the transformer saturates, the magnetic field around the transformer collapses, therefore, the current flow in the secondary winding reverses, turning off the base current in transistor 46 thereby completing a cycle of oscillation. Noise in the base of transistor 46 caused by the changing field in the secondary of transformer 41 is sufficient to initiate conduction in transistor 46 thereby starting the cycle over again. Transistors 46 and 48 provide enough loop gain to sustain the oscillations whether momentary switch 42 is open or closed. Resistor 45 provides a damping function to absorb shock current caused by battery bounce and the like to prevent inadvertent starting of the flash charging circuit that might otherwise occur due to the high gain of transistors 46 and 48. Capacitor 56 is a small valued capacitor, such as 470 pf, and is sized, in known manner, to cause an oscillation frequency that provides a desired rapid rate of capacitor recharge cycle time. The oscillatory current flow in the secondary of transformer 41 is rectified by diode 49 and charges the flash charge capacitor 30 to a negative voltage at full charge of about 330 volts at terminal 30*a*.

In the course of the charging operation, when the voltage across capacitor 30 reaches a predetermined voltage level at terminal 30*a* that is sufficient to sustain illumination in flash tube 24, for example, about −270v, varistor 51 breaks down to initiate current conduction through LED 38 and resistor 39 thereby illuminating the ready light and providing notification to the user that there is sufficient charge on flash capacitor 30 to initiate an exposure sequence. Once varistor 51 breaks down and conducts, a voltage drop is developed across resistor 39 which is also proportional to the charge voltage on flash capacitor 30. Charging of capacitor 30 continues until the voltage at terminal 30*a* reaches −330v. When the flash capacitor 30 is thus fully charged, the voltage across resistor 39 causes varistor 52 to break down and begin conducting. The resulting current through the base of transistor 53 turns the transistor on. This grounds the base of transistor 46 in the self-oscillating charging circuit 40 thereby arresting the self oscillations and terminating further charging of capacitor 30. The actual voltages at which varistors 51 and 52 break down and conduct are a matter of design choice and suitable varistors are commercially available to meet the selected design choices. The use of varistors 51 and 52 saves several cents in cost over the conventional use of neon lights and/or zener diodes and is believed to represent a novel use of these components as voltage sensing devices, particular in camera flash circuits rather than as surge suppression devices for circuit protection purposes.

Flash triggering circuit 60 is conventional and its operation is well known. Briefly, the circuit 60 includes a triggering capacitor 61, transformer 62, a flash tube triggering electrode 64 and a flash sync switch 66. In operation, sync switch 66 is closed by the camera shutter mechanism at the proper time in the exposure sequence. Capacitor 61 discharges through the primary windings of transformer 62, inducing a high voltage on triggering electrode 64 which ionizes the gas in flash discharge tube 24. Flash capacitor 30 then discharges through the flash tube 24, exciting the gas and producing the desired flash illumination. A high valued isolation resistor 65 is provided to maintain the DC charge voltage across trigger capacitor 60 at the same level as flash charge capacitor 30 while minimizing current drain on capacitor 30 during the flash trigger operation.

The energy released in the trigger circuit is fed back to the self-oscillating charging circuit 40 to restart the self-oscillation operation at the conclusion of the picture taking operation. Normally, sufficient feedback would occur through the secondary of oscillation transformer 41 to cause conduction by transistors 46 and 48. However, due to the presence of resistor 45, if flash is initiated after flash capacitor has bled down to a low level such as 270 volts, the feedback through transformer 41 may be insufficient to drive transistors 46 and 48 into conduction. Capacitor 56, which would normally be connected from the base of transistor 46 to ground is, instead, connected to terminal 30*a*, which is effectively an AC ground terminal, to enhance the feedback of energy from the flash illumination circuit to restart oscillations in circuit 40.

The invention has been described with reference to a preferred embodiment. However, it will be appreciated that variations and modifications can be effected by a person of ordinary skill in the art without departing from the scope of the invention.

PARTS LIST

10 camera
12 flash circuit
14 camera body
16 taking lens
18 shutter actuating button
19 flash charging button
20 viewfinder
22 flash device
24 flash tube
28 flash energy supply circuit
30 flash charge capacitor
35 battery
38 LED ready light
40 self oscillating flash charging circuit
41 charging transformer
42 momentary switch
44 resistor
45 resistor
46 NPN transistor
48 NPN transistor
49 rectifier diode
50 oscillation arresting feedback circuit
51 voltage sensing varistor
52 voltage sensing varistor
53 transistor switch capacitor
56 capacitor
60 flash trigger circuit
61 trigger capacitor
62 trigger transformer
64 flash tube trigger electrode
65 isolation resistor
66 flash sync switch

What is claimed is:

1. A flash circuit for a low cost camera including a flash illumination element, a flash capacitor providing energy to illuminate said element, and an oscillating circuit for charging said capacitor; in which the flash circuit comprises:

a voltage sensing circuit including a voltage dependent resistor for sensing a voltage proportional to energy stored in said flash capacitor to produce a control effect on a component in the flash circuit when said voltage reaches a predetermined level.

2. The flash circuit of claim 1 wherein said voltage sensing circuit comprises a flash ready indicator circuit including said voltage dependent resistor and a light emitting diode coupled in series across said flash capacitor.

3. The flash circuit of claim 1 wherein said flash circuit includes a self-oscillating charging circuit and said voltage sensing circuit means comprises an oscillation arresting feedback circuit including a voltage dependent resistor and an oscillation terminating device, said voltage dependent resistor being coupled in circuit with said terminating device to said self-oscillating circuit and being responsive to a voltage representative of full charge voltage on said flash capacitor to terminate oscillations in said oscillating circuit.

* * * * *